US011913338B2

(12) United States Patent
Wu et al.

(10) Patent No.: US 11,913,338 B2
(45) Date of Patent: Feb. 27, 2024

(54) SUPPORT METHOD OF PRESET INTERNAL CABLE FOR IN-SITU TUNNEL EXPANSION PROJECT

(71) Applicant: FUZHOU UNIVERSITY, Fujian (CN)

(72) Inventors: Xuezhen Wu, Fujian (CN); Tao Deng, Fujian (CN); Zhenchang Guan, Fujian (CN); Yujing Jiang, Fujian (CN); Sihong Liu, Fujian (CN)

(73) Assignee: Fuzhou university, Fujian (CN)

( * ) Notice: Subject to any disclaimer, the term of this patent is extended or adjusted under 35 U.S.C. 154(b) by 0 days.

(21) Appl. No.: 17/616,647

(22) PCT Filed: Oct. 14, 2021

(86) PCT No.: PCT/CN2021/123736
§ 371 (c)(1),
(2) Date: Dec. 4, 2021

(87) PCT Pub. No.: WO2022/151774
PCT Pub. Date: Jul. 21, 2022

(65) Prior Publication Data

US 2023/0349293 A1 Nov. 2, 2023

(30) Foreign Application Priority Data

Jan. 15, 2021 (CN) ..... 202110053141.X

(51) Int. Cl.
*E21D 9/01* (2006.01)
*E21D 20/02* (2006.01)
*E21D 21/00* (2006.01)

(52) U.S. Cl.
CPC ..... *E21D 9/01* (2016.01); *E21D 20/021* (2013.01); *E21D 20/025* (2013.01); *E21D 21/008* (2013.01)

(58) Field of Classification Search
CPC ... E21D 20/025; E21D 20/021; E21D 21/008; E21D 9/01
See application file for complete search history.

(56) References Cited

FOREIGN PATENT DOCUMENTS

| | | | | |
|---|---|---|---|---|
| CN | 113417649 A | * | 9/2021 | |
| KR | 20120005680 A | * | 1/2012 | |
| WO | WO-2017090975 A1 | * | 6/2017 | ..... E21D 20/021 |

* cited by examiner

*Primary Examiner* — Janine M Kreck
(74) *Attorney, Agent, or Firm* — Jose Cherson Weissbrot

(57) ABSTRACT

The present invention relates to a support method of preset internal cable for in-situ tunnel expansion project, comprising a cable, lockset and an anchoring agent, wherein before the excavation of the newly-built tunnel, a borehole is drilled into the surrounding rock from the in-situ tunnel, and the cable is installed in the borehole and pre-stressed, so as to play a supporting role at the moment of excavation of the newly-built tunnel. The cable is fixed in the depth of the surrounding rock by the anchoring agent, and the lockset of the cable is set at the position of the excavation contour line of the newly-built tunnel inside the surrounding rock. The present invention provides a method that does not interfere with the excavation construction and can effectively support the surrounding rock of the expanded tunnel in advance. It breaks through the "excavation first and then supports" model in the previous tunnel construction, and uses the space of the in-situ tunnel for pre-support, and by applying prestress, the deformation of surrounding rock can be controlled to the maximum extent.

7 Claims, 2 Drawing Sheets

SUPPORT METHOD OF PRESET INTERNAL CABLE FOR IN-SITU TUNNEL EXPANSION PROJECT

FIELD OF TECHNOLOGY

The present invention belongs to the field of tunnel project, and in particular relates to a support method of preset internal cable for in-situ tunnel expansion project.

BACKGROUND

Due to the increase in traffic, ninny roads need to be expanded on the basis of existing tunnels. Since most of the expanded tunnels are located in cities, the stability control of surrounding rock is an important issue during the expansion of the tunnel. The existence of the in-situ tunnel makes it possible to pre-support the surrounding rock of the new tunnels.

However, the traditional pre-supporting methods for tunnel expansion, such as the patent "A three-dimensional reinforcement construction method suitable for the expansion of collapsed tunnels, CN110397458A", have major problems in practical applications, including (1) the preset rockbolt will interfere with the excavation construction and reduces the excavation efficiency; (2) at the moment of new tunnel excavation, the outer anchoring end of the rockbolt will be destroyed or lose its holding point and the supporting effect will be basically lost; (3) since the outer anchoring end of the rockbolt loses its holding point during excavation, the prestress cannot be effectively applied.

SUMMARY

In view of the defects of the prior art, the present invention aims to provide a support method of preset internal cable for in-situ tunnel expansion project.

In order to solve the above technical problem, the present invention discloses a following technical scheme realizes: a support method of preset internal cable for tunnel expansion project, comprising a cable, a lockset and an anchoring agent, wherein before the excavation of the newly-built tunnel, a borehole is drilled into the surrounding rock from the in-situ tunnel, and the cable is installed in the borehole and pre-stressed, so as to play a supporting role at the moment of excavation of the newly-built tunnel. The cable is fixed in the depth of the surrounding rock by the anchoring agent, and the lockset of the cable is set at the position of the excavation contour line of the newly-built tunnel inside the surrounding rock.

Preferably, when designing the cable layout, it should be arranged according to the excavation contour line of the newly-built tunnel to ensure that the preset cables are uniformly distributed at the excavation contour line of the newly-built tunnel, and the cables are basically perpendicular to the excavation contour line of the newly-built tunnel.

Preferably, wherein the anchoring agent is resin anchoring agent or mortar anchoring agent.

Preferably, the support method specifically comprises the following steps: (1) drilling small-aperture boreholes at the lining of the in-situ tunnel, and the small-aperture boreholes extend from the lining of the in-situ tunnel to the depth of surrounding rocks outside the excavation contour line of the newly-built tunnel; (2) constructing an expanded borehole at the position of the lining borehole of the in-situ tunnel, and the expanded borehole extends from the lining of the in-situ tunnel to the excavation contour line of the newly-built tunnel, and the diameter of the expanded borehole is larger than that the lockset of the cable, so that the lockset of the cable can be directly installed at the excavation contour line of the newly-built tunnel; (3) one end of the cable is anchored in the small-aperture borehole by the anchoring agent, and then the lockset of the cable is installed at the bottom end of the expanded borehole; (4) after the anchoring agent has reached a certain strength, the outer end of the cable is tensioned by the tensioning device, and the lockset is pushed internally by the retractable thrusting device to prevent the lockset from moving outwards, thus applying prestress to the cable; (5) after the excavation of the newly-built tunnel, the part of the cable remaining outside the surrounding rock is cut off, and the rest part is used as a permanent supporting structure.

Preferably, when the resin anchoring agent is adopted as the anchoring agent, first put the resin anchoring agent cartridge into the small-aperture borehole, and then the cable is rotationally drilled through a drilling machine, so that one end of the cable is anchored in the small-aperture borehole; the anchoring agent is required to be prevented from overflowing out of the small-aperture borehole after the cable is installed.

Preferably, when the mortar anchoring agent is adopted as the anchoring agent, the grouting pipe and the cable are placed into the small-aperture borehole together, and the grouting pipe is pulled out while grouting, and ensure that the grouting pipe is always in cement slurry during the pipe pulling process, and the grouting is continued until the cement slurry flows out of an orifice; the small-aperture borehole is densely and fully grouted, so that the cable is anchored in the small-aperture borehole.

Preferably, in order to prevent damage to the surrounding rock of the extension tunnel inside the lockset during blasting excavation and further influence the supporting effect of the cable, after the step (2), a water jet device is inserted into the bottom of the expansion borehole to create a pre-crack at the excavation contour line of the newly-built tunnel, and the pre-crack can reduce the damage degree of blasting to the extension tunnel surrounding rock inside lockset, thereby ensuring the effective anchoring of the outer anchoring end of the cable.

Preferably, the tensioning device is contacted with the lining of the in-situ tunnel in a jacking mode; the thrusting device is a sleeve, one end of the sleeve props against the lockset, the other end of the sleeve props against the tensioning device, and the cable passes through the middle of the sleeve.

Compared with the prior art, the present invention has the following beneficial effects: the present invention provides a method that does not interfere with the excavation construction and can effectively support the surrounding rock of the expanded tunnel in advance. It breaks through the "excavation first and then supports" model in the previous tunnel construction, and uses the space of the in-situs tunnel for pre-support and applying prestress, the deformation of surrounding rock can be controlled to the maximum extent. The lockset of the cable is directly arranged at the excavation contour line of the newly-built tunnel inside the surrounding rock, which will not interfere with the excavation of the newly-built tunnel, and at the same time ensure that the outer anchor end will not be damaged by the excavation of the newly-built tunnel and the prestress will not be lost, so that can of effectively pre-support the surrounding rock of the expanded tunnel.

The present invention is described in further detail below with reference to the drawings and the detailed, description.

DESCRIPTION OF THE EMBODIMENTS

In order to make the above-mentioned features and advantages of the present invention more comprehensible, the following specific examples are given in conjunction with the drawings, and detailed descriptions are made as follows.

Figure 1:
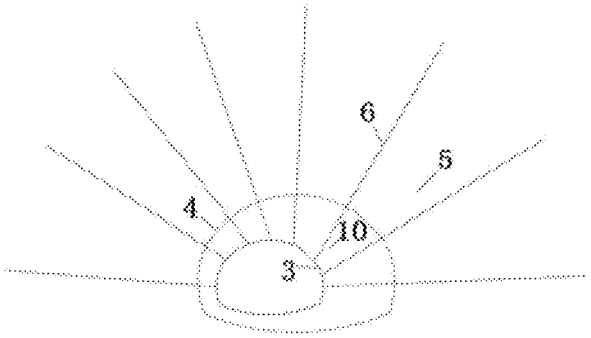
FIG. 1 is a general schematic diagram of the extending tunnel supports.
Figure 2:
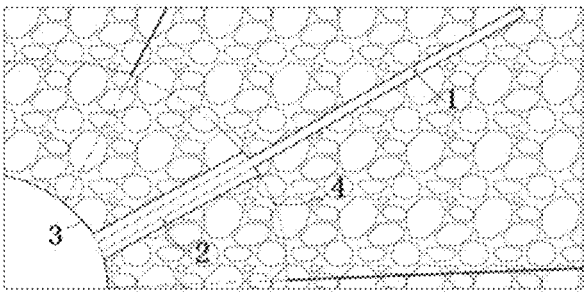
FIG. 2 is a schematic diagram of the borehole.
Figure 3:
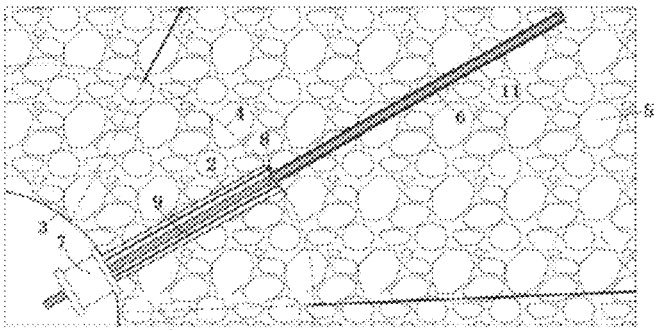
FIG. 3 is a schematic diagram of the cable installed in the borehole.
Figure 4:
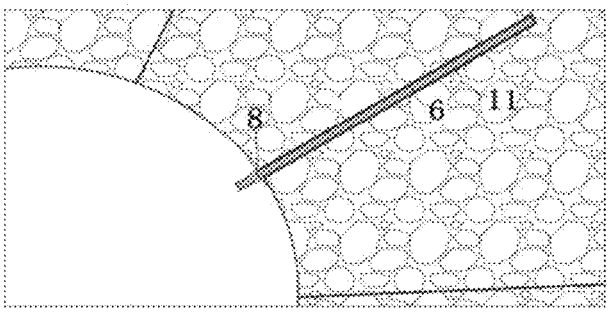
FIG. 4 is a schematic diagram of after the construction of the cable is completed.
Figure 5:
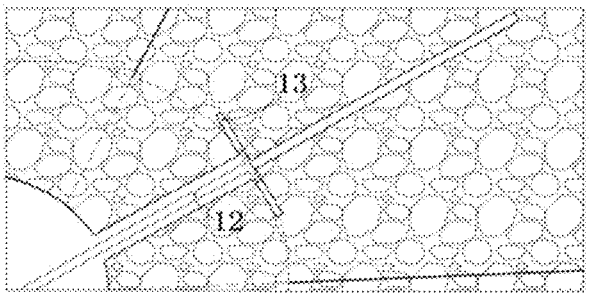
FIG. 5 is a schematic diagram of the construction of the pre-crack.

As shown in FIG. 1 to 5, a support method of preset internal cable for in-situ tunnel expansion project, comprising a cable 6, a lockset 8 and an anchoring agent, and is characterized in that before the excavation of the newly-built tunnel, a borehole is drilled into the surrounding rock from the in-situ tunnel, and the cable is installed in the borehole and pre-stressed, so as to play a supporting role at the moment of excavation of the newly-built tunnel. The cable is fixed in the depth of the surrounding rock by the anchoring agent, and the lockset of the cable is set at the position of the excavation contour line of the newly-built tunnel inside the surrounding rock, and a pre-excavation rock mass 10 is arranged between the excavation contour line of the newly-built tunnel and the lining of the in-situ tunnel.

In the embodiment of the present invention, when designing the cable layout, it should be arranged according to the excavation contour line of the newly-built tunnel to ensure that the preset cables are uniformly distributed at the excavation contour line of the newly-built tunnel, and the cables are basically perpendicular to the excavation contour line of the newly-built tunnel.

In the embodiment of the present invention, the anchoring agent 11 is resin anchoring agent or mortar anchoring agent.

In the embodiment of the present invention, the support method specifically comprises the following steps: (1) drilling small-aperture boreholes at the lining of the in-situ tunnel, and the small-aperture boreholes extend from the lining of the in-situ tunnel to the depth of surrounding rocks 5 outside the excavation contour line of the newly-built tunnel; (2) constructing an expanded borehole 2 at the position of the lining borehole of the in-situ tunnel, and the expanded borehole extends from the lining of the in-situ tunnel to the excavation contour line 4 of the newly-built tunnel, and the diameter of the expanded borehole is larger than that the lockset of the cable, so that the lockset of the cable can be directly installed at the excavation contour line of the newly-built tunnel; (3) one end of the cable is anchored in the small-aperture borehole by the anchoring agent, and then the lockset of the cable is installed at the bottom end of the expanded borehole; (4) after the anchoring agent has reached a certain strength, the outer end of the cable is tensioned by the tensioning device 7, and the lockset is pushed internally by the retractable thrusting device 9 to prevent the lockset from moving outwards, thus applying prestress to the cable; (5) after the excavation of the newly-built tunnel, the part of the cable remaining outside the surrounding rock is cut off, and the rest part is used as a permanent supporting structure.

In the embodiment of the present invention, when the resin anchoring agent is adopted as the anchoring agent, first put the resin anchoring agent cartridge into the small-aperture borehole, and then the cable is rotationally drilled through a drilling machine, so that one end of the cable is anchored in the small-aperture borehole; the anchoring agent is required to be prevented from overflowing out of the small-aperture borehole after the cable is installed.

In the embodiment of the present invention, when the mortar anchoring agent is adopted as the anchoring agent, the grouting pipe and the cable are placed into the small-aperture borehole together, and the grouting pipe is pulled out while grouting, and ensure that the grouting pipe is always in cement slurry during the pipe pulling process, and the grouting is continued until the cement slurry flows cut of an orifice; the small-aperture borehole is densely and fully grouted, so that the cable is anchored in the small-aperture borehole.

In the embodiment of the present invention, in order to prevent damage to the surrounding rock of the extension tunnel inside the lockset during blasting excavation and further influence the supporting effect of the cable, after the step (2), a water jet device 12 is inserted into the bottom of the expansion borehole to create a pre-crack 13 at the excavation contour line of the newly-built tunnel, and the pre-crack can reduce the damage degree of blasting to the extension tunnel surrounding rock inside lockset, thereby ensuring the effective anchoring of the outer anchoring end of the cable.

In the embodiment of the present invention, the tensioning device is contacted with the lining of the in-situ tunnel in a jacking mode; the thrusting device is a sleeve, one end of the sleeve props against the lockset, the other end of the sleeve props against the tensioning device, and the cable passes through the middle of the sleeve.

The present invention is not limited to the above preferred embodiments, and any person can derive various other forms of the support method of preset internal cable for in-situ tunnel expansion project according to the teaching of the present invention. AU equivalent changes and modifications made according to the claims of the present invention should be covered by the present invention.

What is claimed is:

1. A support method of preset internal cable for in-situ tunnel expansion project, comprising a cable, a lockset and an anchoring agent, and is characterized in that: before excavation of the newly-expanded tunnel, a borehole is drilled into the surrounding rock from the in-situ tunnel, and the cable is installed in the borehole and pre-stressed, so as to play a supporting role at the moment of excavation of the newly-expanded tunnel; the cable is fixed in a depth of the surrounding rock by the anchoring agent, and the lockset of the cable is set at a position of the excavation contour line of the newly-expanded tunnel inside the surrounding rock; the support method specifically comprises the following steps: (1) drilling small-aperture boreholes at a lining of the in-situ tunnel, and the small-aperture boreholes extend from the lining of the in-situ tunnel to the depth of surrounding rocks outside the excavation contour line of the newly-expanded tunnel; (2) constructing an expanded borehole at a position of the lining borehole of the in-situ tunnel, and the expanded borehole extends from the lining of the in-situ tunnel to the excavation contour line of the newly-expanded tunnel, and the diameter of the expanded borehole is larger than that the lockset of the cable, so that the lockset of the cable can be directly installed at the excavation contour line of the newly-expanded tunnel; (3) one end of the cable is anchored in the small-aperture borehole by means of the anchoring agent, and then the lockset of the cable is installed at the bottom end of the expanded borehole; (4) after the anchoring agent has reached a certain strength, the outer end of the cable is tensioned by a tensioning device, and the lockset is pushed internally by a retractable thrusting device to prevent the lockset from moving outwards, thus applying prestress to the cable; (5) after the excavation of the newly-built tunnel, the part of the cable remaining outside the surrounding rock is cut off, and the rest part is used as a permanent supporting structure.

2. The support method of preset internal cable for in-situ tunnel expansion project as claimed in claim 1, wherein when designing the cable layout, it should be arranged according to the excavation contour line of the newly-expanded tunnel to ensure that the preset internal cables are uniformly distributed at the excavation contour line of the newly-expanded tunnel, and the cables are basically perpendicular to the excavation contour line of the newly-expanded tunnel.

3. The support method of preset internal cable for in-situ tunnel expansion project as claimed in claim 1, wherein the anchoring agent is resin anchoring agent or mortar anchoring agent.

4. The support method of preset internal cable for in-situ tunnel expansion project as claimed in claim 3, wherein when the resin anchoring agent is adopted as the anchoring agent, first put the resin anchoring agent cartridge into the small-aperture borehole, and then the cable is rotationally drilled through a drilling machine, so that one end of the cable is anchored in the small-aperture borehole; the anchoring agent is required to be prevented from overflowing out of the small-aperture borehole after the cable is installed.

5. The support method of preset internal cable for in-situ tunnel expansion project as claimed in claim 3, wherein when the mortar anchoring agent is adopted as the anchoring agent, a grouting pipe and the cable are placed into the small-aperture borehole together, and the grouting pipe is pulled out while grouting, and ensure that the grouting pipe is always in cement slurry during the pipe pulling process, and the grouting is continued until the cement slurry flows out of an orifice; the small-aperture borehole is densely and fully grouted, so that the cable is anchored in the small-aperture borehole.

6. The support method of preset internal cable for in-situ tunnel expansion project as claimed in claim 1, wherein in order to prevent damage to the surrounding rock of the newly-expanded tunnel inside the lockset during blasting excavation and further influence the supporting effect of the cable, after the step (2), a water jet device is inserted into the bottom of the expansion borehole to create a pre-crack at the excavation contour line of the newly-expanded tunnel, and the pre-crack can reduce the damage degree of blasting to the extension tunnel surrounding rock inside cable tray, thereby ensuring the effective anchoring of the outer anchoring end of the cable.

7. The support method of preset internal cable for in-situ tunnel expansion project as claimed in claim 1, wherein the tensioning device is contacted with the lining of the in-situ tunnel in a jacking mode; the thrusting device is a sleeve, one end of the sleeve props against the lockset, the other end of the sleeve props against the tensioning device, and the cable passes through the middle of the sleeve.

* * * * *